US008904599B2

(12) United States Patent
Migli et al.

(10) Patent No.: US 8,904,599 B2
(45) Date of Patent: Dec. 9, 2014

(54) QUICK COUPLING FURNITURE HINGE

(71) Applicant: Lama D.D. Dekani, Dekani (SI)

(72) Inventors: Carlo Migli, Lecco (IT); Valter Švara, Izola (SI)

(73) Assignee: Lama D.D. Dekani, Dekani (SI)

( * ) Notice: Subject to any disclaimer, the term of this patent is extended or adjusted under 35 U.S.C. 154(b) by 0 days.

(21) Appl. No.: 14/348,532

(22) PCT Filed: Sep. 28, 2012

(86) PCT No.: PCT/SI2012/000053

§ 371 (c)(1),
(2), (4) Date: Mar. 28, 2014

(87) PCT Pub. No.: WO2013/048349

PCT Pub. Date: Apr. 4, 2013

(65) Prior Publication Data

US 2014/0259526 A1 Sep. 18, 2014

(30) Foreign Application Priority Data

Sep. 28, 2011 (SI) ..... 201100386

(51) Int. Cl.

| | |
|---|---|
| ***E05D 7/10*** | (2006.01) |
| ***E05D 5/02*** | (2006.01) |
| ***E05D 5/06*** | (2006.01) |
| ***E05D 7/12*** | (2006.01) |

(52) U.S. Cl.

CPC ..... *E05D 5/0276* (2013.01); *E05D 5/065* (2013.01); *E05D 7/123* (2013.01)

USPC ..... 16/258; 16/382

(58) Field of Classification Search

USPC ..... 16/257, 258, 259, 254, 271, 272, 382, 16/383

See application file for complete search history.

(56) References Cited

U.S. PATENT DOCUMENTS

| | | | | | |
|---|---|---|---|---|---|
| 3,969,787 | A | | 7/1976 | Rock et al. | |
| 4,800,621 | A | * | 1/1989 | Rock et al. | 16/235 |
| 4,823,436 | A | * | 4/1989 | Salice | 16/258 |
| 5,022,116 | A | * | 6/1991 | Salice | 16/258 |
| 5,025,530 | A | * | 6/1991 | Ferrari et al. | 16/236 |
| 5,056,189 | A | * | 10/1991 | Brustle et al. | 16/235 |
| 5,119,527 | A | * | 6/1992 | Rock | 16/258 |
| 5,276,944 | A | * | 1/1994 | Lin | 16/258 |
| 5,611,112 | A | * | 3/1997 | Rock et al. | 16/237 |

(Continued)

FOREIGN PATENT DOCUMENTS

EP 0369532 A1 5/1990

OTHER PUBLICATIONS

International Search Report; PCT/SI2012/000053; May 29, 2013.

*Primary Examiner* — Chuck Mah

(74) *Attorney, Agent, or Firm* — Studebaker & Brackett PC

(57) ABSTRACT

A quick coupling furniture hinge for a quick arrangement of a door of a furniture element onto a base furniture element, wherein the hinge comprises a hinge pot arranged in the furniture door and a hinge arm pivotably fastened thereon. The hinge arm is provided with a mounting assembly fixed in the hinge arm, via which mounting assembly the hinge arm is fastened to a base mounting panel that is fixed on the base furniture element, so that the pivotable assemblies co-operate independently from each other with each complementarily shaped element arranged on the base mounting panel.

4 Claims, 2 Drawing Sheets

(56) References Cited

U.S. PATENT DOCUMENTS 5,937,479 A * 8/1999 Ohshima et al. ..... 16/257
6,032,333 A * 3/2000 Brustle ..... 16/242
6,148,479 A 11/2000 Lin
2005/0172451 A1 8/2005 Kashiwaguma

* cited by examiner

QUICK COUPLING FURNITURE HINGE

SUBJECT OF THE INVENTION

The subject of the present invention is a quick coupling furniture hinge for a quick arrangement of a furniture element door onto a base furniture element, wherein the hinge comprises a hinge pot arranged in a furniture door and a hinge arm pivotably fastened therein. The hinge arm is provided with a mounting assembly fixed in the hinge arm, via which mounting assembly the hinge arm is fastened onto a pre-fastened mounting panel in the base furniture element.

Technical Problem

The technical problem solved by the present invention is how to design a quick coupling furniture hinge that would allow a simple, quick, reliable and safe coupling of the hinge arm with a mounting panel fixed in a furniture element as well as a simple uncoupling therefrom without a use of any tool and without any precise mounting instructions; furthermore, its construction will be technologically simple.

Prior Art

A furniture hinge comprising a hinge pot integrated in a door wing of a furniture and a hinge arm pivotably connected with the hinge pot makes it possible to arrange a furniture door onto a furniture carcass in a way for the door to open and close. A hinge arm of an oblong shape with a U-shaped cross-section is fastened onto a carcass by way of an interface mounting element that is detachably installed in a hinge arm in a way that the longitudinal axes of both elements, i. e. the hinge arm and the mounting element, are coincident. The interface mounting element and the mounting base panel are therefore designed in a way that a form-locking and a force-locking connection is formed between them.

Several shapes of such connections are known. A connection between a mounting element and a mounting base panel can be carried out without a use of any tool by way of snap connections: at one end of a mounting element a fixed clamp-shaped element is arranged and engages with a complementarily shaped groove on a base mounting panel or vice versa, and at the other, opposite end of a mounting element a pivotable wedge element is arranged that engages into a complementarily shaped groove on a base mounting panel. In such a case one has to be acquainted with a mounting procedure, follow instructions and precisely carry out individual steps, otherwise mounting is not possible. A further problem appears in the case when a door wing needs to be fixed in several points.

EP 0 369 532 A1 (Ferrari) discloses a quick coupling furniture hinge that is mounted by way of an intermediate element inserted into a hinge arm and having a pivotable wedge element at each end. The wedge element is actually a roller extending transversally to the longitudinal axis of the hinge arm and thus also to the longitudinal axis of the mounting element between two vertical walls of the latter and is supported in an arc like groove of each vertical wall. At each side between two parallel rollers there is arranged one arc-like spring pressing with its ends to the rollers and forcing them one against the other. The hinge arm is arranged onto a base mounting panel in a way that the arm is pushed together with the intermediate mounting element in direction towards the base mounting panel. The base mounting panel has a back wall specially designed for arrangement purposes that ends in longitudinal direction each time with a tooth. When encountering the back wall, the rollers spread apart and glide along the back wall until they slip over the tooth into the groove having a shape that complements the roller outer surface. The force of the spring acts counter the force of movement and maintains the rollers into the groove.

A drawback of the disclosed solution lies in that each individual roller is fixed in two arc-like opposite lying grooves that are arranged in opposite side walls of the mounting element. If both grooves lie at least slightly not axially, the roller may fall out of the groove. A connection only seems to be coupled or formed, which can cause a door to fall. Apart from that, individual ends of each roller are acted upon by forces of each spring, wherein a force arm, with which the spring acts upon the roller, is very big. In the case when the properties of both springs are not completely the same, the force acting upon one end of the roller differs from the force at the other end of the roller, which leads to an asymmetric load and to a possibility for the roller to fall out of the groove. While in use, i. e. when the door is mounted onto a furniture carcass, a user gets a feeling that the hinge has coupled with the base mounting panel when the roller fell out of the groove. Actually, the hinge is only partially fixed and the door may fall.

In U.S. Pat. No. 3,969,787 a hinge device is described having two mutual independent hook members disposed on pins by way of an ear at each end of a hinge arm. Each hook member is pivotally connected with an intermediate part and snapped into a recess of a mounting plate. To ensure that the hook members snap into the recess, springs are provided to abut against the intermediate part and to act upon the hook member.

Solution to the Technical Problem

The technical problem is solved by a quick coupling furniture hinge for a quick arrangement of a furniture element door onto a base furniture element, wherein the hinge comprises a hinge pot arranged in the furniture door, and a hinge arm pivotably fastened thereon. The hinge arm is provided with a mounting assembly fixed in the hinge arm, via which mounting assembly the hinge arm is fastened onto a mounting panel pre-fastened in the base furniture element, wherein the mounting assembly contains on its each end a pivotable assembly for coupling that independently from each other co-operate with each complementary element on the base mounting panel with the purpose of forming a fixed yet detachable connection between the mounting element integrated in the hinge arm, and the base mounting panel that is fixed on the base wall of a furniture element. At the end remote from the turning point of the hinge arm, the mounting element is provided with a pivotable interlocking assembly mounted on a transversal bolt, the axis of which is perpendicular to the longitudinal axis of the mounting element. At the end close to the turning point of the hinge arm, the mounting element is provided with a pivotable lath that lies transversally to the main longitudinal axis of the mounting element and abuts with its each end against the cut-outs of the side wall of the mounting element, and with a push spring that forces the lath into the final locked position.

The pivotable assembly for coupling that are arranged each at an end of the mounting element act independently from each other. Flexibility of both pivotable assemblies for coupling allows a user to arrange the hinge arm onto the base mounting panel by only using the force acting actually perpendicularly to the base mounting panel, i. e. by pressing the hinge arm onto the base furniture element. As pivotable assemblies for coupling couple with the base mounting element independently from each other, a certain point of application of the push force is not required. Fastening of the hinge arm can be asymmetric, it can be done first at one end and then at the other end of the mounting element, and yet the hinge arm will fully couple with the base mounting panel.

The quick coupling furniture hinge of the invention allows a simple mounting/dismounting without any obligatory prescribed procedure steps. It further allows mounting in the case when several hinges are arranged on one door of a furniture element. Due to the mounting mode made possible by the quick coupling hinge of the invention, not all hinges need to be coupled simultaneously, coupling can be done sequentially.

BRIEF DESCRIPTION OF THE DRAWINGS

The invention will now be described in more detail with reference to an embodiment, but not limited to it, and with reference to enclosed drawings which show.

DETAILED DESCRIPTION OF THE PREFERRED EMBODIMENTS

Figure 1:
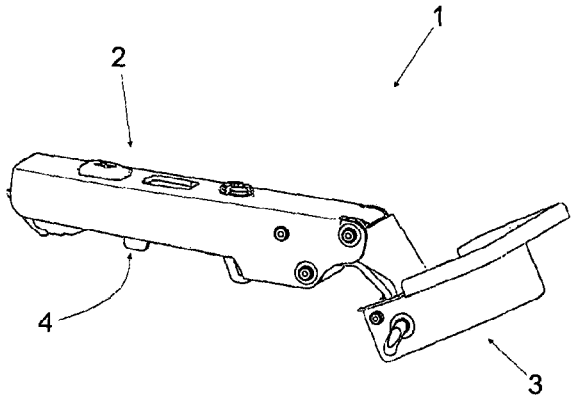
FIG. 1 A quick coupling hinge of the invention.
Figure 2:
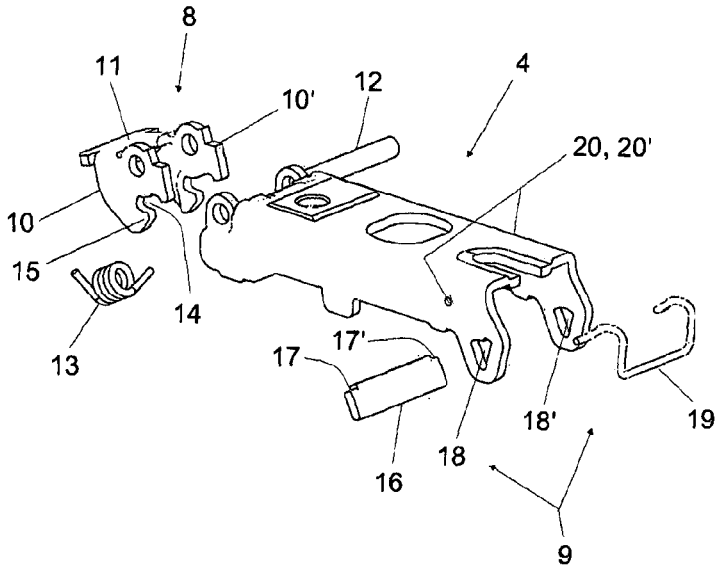
FIG. 2 A mounting element with pivotable assemblies for coupling in exploded view.
Figure 3:
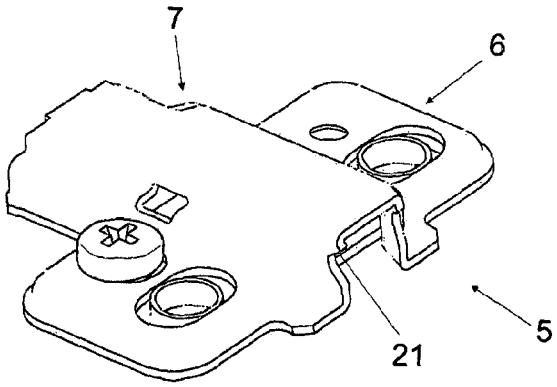
FIG. 3 A base mounting panel.
Figure 4:
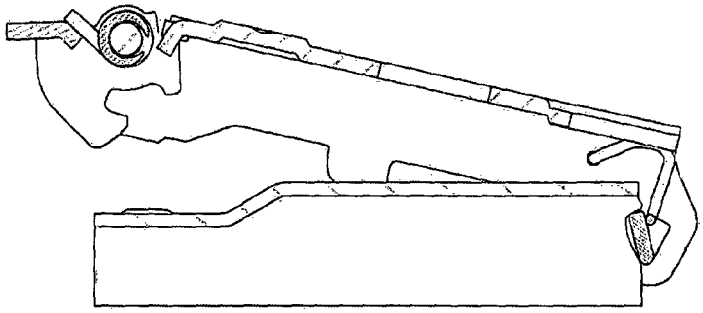
FIG. 4 A cross-section of coupling of the quick coupling hinge of the invention with the base mounting panel with asymmetric acting of a force, when coupling starts at the end of a pivotable lath-like assembly.
Figure 5:
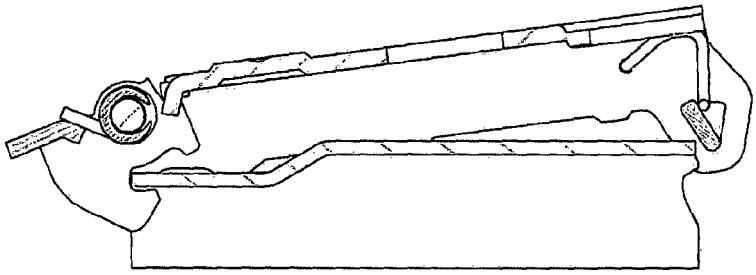
FIG. 5 A cross-section of coupling of the quick coupling hinge of the invention with the base mounting panel with asymmetric acting of a force, when coupling starts at the end of a pivotable interlocking assembly.
Figure 6:
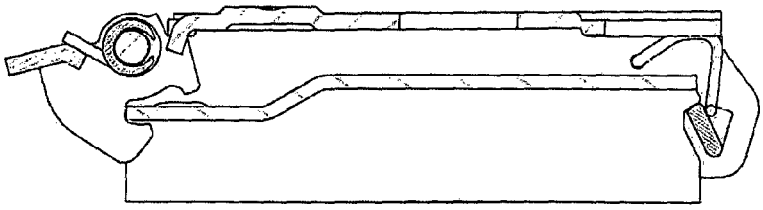
FIG. 6 A cross-section of a quick coupling hinge in a coupling phase.

A quick coupling furniture hinge 1 for a quick arrangement and detachment comprises a hinge arm 2 and a hinge pot 3 that are pivotably connected with each other. The hinge pot 3 that is not the subject of the invention is fixed in a cut-out on a door of a furniture element. The hinge arm 2 that is of an oblong shape and features an upside down U in a cross-section embraces an inserted mounting element 4, via which the hinge arm 2 connects with a base mounting panel 5 that is permanently fastened on the base furniture element The base mounting panel 5, which is not the subject of the invention, comprises a fastening part 6 for fastening into the base furniture element, and a coupling part 7 for coupling with the mounting element 4 and thus with the hinge arm 2. Like the hinge arm 2, the mounting element 4 is also oblong with a U-shaped cross-section. The mounting element 4 comprises at its each free end a pivotable assembly 8, 9 that forms connection with the base mounting panel 5. At the end remote from the turning point of the hinge arm 2, the mounting element 4 is provided with a pivotable interlocking assembly 8 of a known type, and at the end close to the turning point of the hinge arm, the mounting element is provided with a lath-like pivotable locking bar 9.

The pivotable interlocking assembly 8, which can be of any optional known type, is designed in the embodiment as a pair of mutually parallel locking elements 10, 10' that are connected in a self-substance manner with an uncoupling connection 11. The pivotable interlocking assembly 8 is mounted on a transversal bolt 12 that is freely mounted in cut-outs at each side wall of the mounting element and its axis is perpendicular to the longitudinal axis of the mounting element 4. A torsion spring 13 is also arranged on the bolt 12 and is intended to uncouple the pivotable interlocking assembly 8 and the base mounting panel 5. Each locking element 10, 10' is provided at the side facing the mounting element 4 with a groove 14 that is adapted to the coupling part 7 of the base mounting panel 5 in its position and dimension. Under the groove 14 there is a locking tooth 15 that, when coupled, fits under the coupling part 7 of the base mounting panel 5.

At the end close to the turning point of the hinge arm 2, the mounting element 4 is provided with the pivotable lath-like assembly 9 that comprises a pivotable lath 16 arranged transversally to the main longitudinal axis of the mounting element 4 in a way to fit with its each free end 17, 17' in cut-outs 18, 18' of each side wall of the mounting element 4, and a push spring 19 that is fixed in each side wall of the mounting element 4 and pushes said pivotable lath 16 into the final locked position. Each cut-out 18, 18' has a shape of a substantially upside-down equilateral triangle with a stepped base, which allows insertion of the pivotable lath 16. One longitudinal edge of the pivotable lath 16 is rounded, wherein the rounded section complements the rounded section at the top of the triangular cut-out 18, 18', whereas the other, opposite longitudinal edge of the pivotable lath 16 is chamfered at both sides in a stepped manner and the length of the cut-out corresponds to the depth of the cut-out 18, 18' and thus also to the thickness of the side wall of the mounting element 4. Such shape of the pivotable lath 16 allows its insertion into triangular cut-outs 18, 18' of the mounting element 4. If the pivotable lath 16 is pivoted in the triangular cut-out from a starting position with a larger height of the triangle into a final position with a smaller height of the triangle the longitudinal move is prevented and the pivotable lath 16 cannot fall out of each cut-out 18, 18'. The pivotable lath 16 pivots due to a biased push spring 19 shaped substantially as a wide letter U, the legs of which are fastened in coaxial holes 20, 20' at each side wall of the mounting element 4. When coupling, the pivotable lath 16 engages into a specially shaped tooth 21 on the coupling part 7 of the base mounting panel 5.

The fundamental mode of fastening the quick coupling hinge arm 2 of the invention, which is preferably pivotably fastened on the door of a furniture element, onto the base mounting panel 5 arranged on the base furniture element is as follows: the hinge arm 2 is pushed with a force exerted vertically onto the side wall of a furniture element against said side wall. Both pivotable assemblies 8, 9 spread apart and when the hinge arm 2 reaches the final position, the locking elements 10, 10' of the interlocking assembly 8 fit under the coupling part 7 of the base mounting panel 5 and the pivotable lath 16 engages under the tooth 21 of the coupling part 7 of the base mounting panel 5. When locking, the pivotable lath 16 slides over the end edge of the coupling part 7 and pivots towards the starting position, which is unreachable due to the action of the opposite force of the biased push spring 19. The pivotable lath 16 can thus not fall from the cut-out 18, 18'. When the hinge arm 2 reaches the final position of coupling, the force of the spring pushes the pivotable lath 16 to its end position and keeps it in that position during the entire coupling.

Both parts can be coupled also in the case when the force of push is not exerted completely vertically on the surface, when the push force does not act on both pivotable assemblies equally or when the push force keeps acting on one pivotable assembly and then on the other. Complete coupling is reached in all cases. If the described mounting element of the invention is used, the hinge arm needs not previously be locked at one side or longitudinally moved.

Uncoupling of the hinge arm 2 from the base element is carried out in reverse order from the disclosed coupling. The pivotable assembly 8 therefore has an uncoupling connection 11 with a push member to release the locking elements 10, 10', wherein one side of the hinge arm 2 is uncoupled from the base mounting panel 5. The hinge arm 2 is then shifted in longitudinal direction towards the hinge pot 3, with which the locking of the pivotable lath 16 is released.

It is understood that a person skilled in the art can design individual changes to the embodiment based on knowing the above description of the invention without circumventing the essence of the invention defined in the appended patent claims.

The invention claimed is:

1. A quick coupling furniture hinge (1) for a quick arrangement of a door of a furniture element onto a base furniture element, wherein the hinge comprises a hinge pot (3) arranged in the furniture door and a hinge arm (2) pivotably fastened at a turning point thereon; the hinge arm (2) is provided with a mounting element (4) fixed in the hinge arm, via which mounting element the hinge arm (2) is fastened to a base mounting panel (5) that is fixed on the base furniture element, the mounting element (4) comprising two ends, each said end having a pivotable interlocking assembly (8, 9), both assemblies co-operate independently from each other with the base mounting panel (5), whereby the pivotable assembly (9) disposed at the end close to the turning point of the hinge arm (2) comprises a lath (16) and a push spring (19), characterized in that the lath (16) is pivotable and arranged perpendicularly to the main longitudinal axis of the mounting element (4) and disposed with its ends (17, 17') in cut-outs (18, 18') arranged in respective side walls of the mounting element (4) and the push spring (19) is fastened in each side wall of the mounting element (4) and pushes said pivotable lath (16) to a final locked position.

2. The quick coupling furniture hinge according to claim 1, characterised in that each cut-out (18, 18') has a shape of a substantially upside-down equilateral triangle with a stepped base that allows insertion of the pivotable lath (16).

3. The quick coupling furniture hinge according to any of preceding claim, characterised in that one longitudinal edge of the pivotable lath (16) is rounded, wherein the rounded section complements a rounded section at the top of the triangular cut-out (18, 18'), whereas the other, opposite longitudinal edge of the pivotable lath (16) is chamfered at both ends in a stepped manner and the length of each step corresponds to the depth of the cut-out (18, 18').

4. The quick coupling furniture hinge according to claim 1, characterised in that at the end remote from the turning point of the hinge arm (2), the pivotable interlocking assembly (8) is designed as a pair of mutually parallel locking elements (10, 10') that are connected in a material-fit manner with an uncoupling connection (11) that allows uncoupling of the hinge arm (2) from the base mounting panel (5).

* * * * *